US005148851A

United States Patent [19]

Murata

[11] Patent Number: 5,148,851

[45] Date of Patent: Sep. 22, 1992

[54] METHOD OF CHARGING SAND AND MOLDING MACHINE UTILIZING THEREOF

[75] Inventor: Yutaka Murata, Toyokawa, Japan

[73] Assignee: Sintokogio Ltd., Nagoya, Japan

[21] Appl. No.: 722,426

[22] Filed: Jun. 27, 1991

[30] Foreign Application Priority Data

Jun. 29, 1990 [JP] Japan ..... 2-172862

[51] Int. Cl.[5] ..... B22C 15/28

[52] U.S. Cl. ..... 164/20; 164/38; 164/182; 164/195; 164/201

[58] Field of Search ..... 164/20, 19, 21, 22, 164/38, 182, 195, 201

[56] References Cited

U.S. PATENT DOCUMENTS 3,730,250 5/1973 Fellows ..... 164/22
3,744,549 7/1973 Buhler .
4,313,486 2/1982 Kondo et al. ..... 164/38
4,411,303 10/1983 Shioda ..... 164/195 X
4,463,794 8/1984 Shioda ..... 164/182

FOREIGN PATENT DOCUMENTS 59-107746 6/1984 Japan ..... 164/195
2-16829 5/1990 Japan .

*Primary Examiner*—J. Reed Batten, Jr.
*Attorney, Agent, or Firm*—Armstrong, Nikaido, Marmelstein, Kubovcik & Murray

[57] ABSTRACT

Sand is charged into a space in a mold flask by a sand feed nozzle provided on the lower end part of a blow head inserted into a sand charge port formed in the top wall of the mold flask. The blow head is further lowered after completion of the charging so as to deeply insert the sand feed nozzle in the sand charge port in order to press the sand in the vicinity of the sand charge port within the mold flask, thereby uniformly compacting the entire sand in the space.

6 Claims, 3 Drawing Sheets

METHOD OF CHARGING SAND AND MOLDING MACHINE UTILIZING THEREOF

BACKGROUND OF THE INVENTION

The present invention relates to a method of forming a sand mold, and in particular to a method of charging sand into a space defined in a mold flask held between a vertically arranged match plate and a squeeze plate. Further, the present invention also relates to a molding machine for utilizing the above-mentioned sand charging method.

DESCRIPTION OF THE RELATED ART

Molding machines which use a vertically arranged match plate are well known. One example of these molding machines is shown in FIG. 1, in which a vertically arranged match plate 1 is clamped between two mold flasks 4, 4, each of which is formed in its top wall with a sand charge port 2 and vent holes 3*a* and in its bottom wall with a plurality of vent holes 3 and which are aligned with each other with the match plate 1 intervening therebetween. As clearly shown in FIG. 1, one of each of the openings of the mold flask is airtightly pressed against the associated surface of the match plate 1 and surrounds a mold pattern secured to the match plate, and the other of the openings of the mold flask is free and receives therethrough a squeeze plate 7 carried by a piston rod of a fluid cylinder 6. With this arrangement, an elevatable blow head 8 is lowered in order to press sand feed ports 9, 9 against the upper walls of the mold flasks 4, 4 while aligning them with the charge ports 2, 2, respectively, and then sand is charged from the blow head 8 into spaces defined in the mold flasks 4 clamping the match plate 1 and fitted in their free openings 5, 5 with the squeeze plates 7, 7. In this phase, compressed air is also fed into the spaces from the blow head 8 through the sand feed ports 9, 9 and the sand charge ports 2, 2, and is then discharged to the outside through the vent holes 3, 3*a*. Thus, the sand can be densely charged in the spaces. Then, the fluid cylinders 6 are actuated so as to press the squeeze plates 7, 7 against the charged sand which is therefore squeezed into compact sand molds.

In the above-mentioned arrangement, the sand is built up in the spaces so that the level of the charged sand is gradually heightened, so that the air-vent capacity of the vent holes 3 in the bottom walls of the flasks 4, 4 is smaller than that of the vent holes 3*a* in the top walls thereof. Accordingly, the higher the level of the charged sand, the lower the air-vent capacity becomes, causing a remarkable increase in the pressure in the spaces within the mold flasks 4, 4.

An increase in the pressure of the spaces lowers the charging speed of sand into the mold spaces. The nearer to the level of the sand charge ports, the lower the density of the charged sand becomes. Thus, irregularity in the hardness of sand molds is caused even after the compaction of the sand by the squeeze plates 7, 7. Further, humping is caused in a higher charged density part in the sand during compaction by the squeeze plates 7, 7, and accordingly, the rear surfaces of each sand mold, which should be in parallel with the match plate 1, are caused to be slanted. Accordingly, mold defects such as height differences on the surface of the mold, crushing, and the like can possibly occur. Thus, these disadvantages prevent a satisfactory sand mold from being obtained.

BRIEF SUMMARY OF THE INVENTION

The present invention addresses the above-mentioned problems, and accordingly, one object of the present invention is to provide a method of charging sand which can eliminate the above-mentioned disadvantages.

The other object of the present invention is to provide an apparatus which can carry out the above-mentioned method.

To this end, according to the present invention, there is provided a method of charging sand into a space in a vertically arranged mold flask, the mold flask being formed with a sand charge port having a given depth and a plurality of vent holes in its top wall and with a plurality of vent holes in bottom wall, and having defined openings on both sides which are closed airtight, respectively, by a match plate and a squeeze plate, the method comprising the steps of: inserting the sand feed nozzle into the sand charge port at an intermediate depth of the sand charge port; charging sand into the space from the blow head together with compressed air through the sand feed nozzle and the sand charge port while venting air from the space through the vent holes so as to fill the space with the sand; and forcing the sand feed nozzle inserted in the sand charge port into advancing deeply into the sand charge port by a certain depth so as to compress the sand charged in the space.

According to a further aspect of the present invention, there is provided a molding machine comprising: a match plate having a side surface which carries thereon a mold pattern; a mold flask arranged vertically and having a top wall formed therein with a sand charge port and a plurality of vent holes, and a bottom wall formed therein with a plurality of vent holes, and defining therein first and second side openings, the first side opening being pressed against the one surface of the match plate while the second side opening receiving therethrough a squeeze plate carried by a squeeze drive means so as to define a closed space within the mold flask; a blow head located above the mold flask and having a sand feed nozzle adapted to be inserted in the sand charge port in said top wall of the mold flask, for charging sand and compressed air into the space; means for lowering the blow head so as to insert the sand feed nozzle into the sand charge port of the mold flask; and a control means for controlling the lowering means so as to lower the blow head in order to insert the sand feed nozzle into the sand charge port by an intermediate depth during charging the sand into the space, and then to further lower the blow head so as to insert the sand feed nozzle through the sand charge port to a full depth after completion of sand charging.

Other features and advantages of the present invention, in addition to those mentioned above will become more apparent from the description of the preferred embodiment stated hereinbelow with reference to the drawings in which:

BRIEF DESCRIPTION OF THE DRAWINGS

FIGS. 2 and 3 are transverse sectional views illustrating an embodiment of the present invention, among which FIG. 2 shows a sand blowing condition, and FIG. 3 shows a sand pressing condition;

DESCRIPTION OF THE PREFERRED EMBODIMENTS

Figure 1:
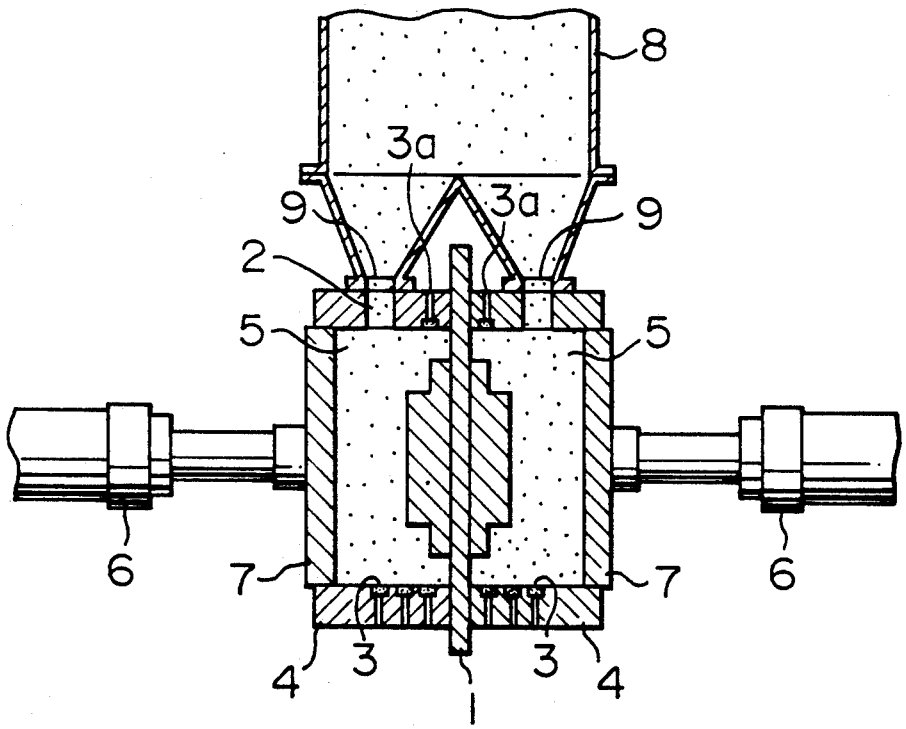
FIG. 1 PRIOR ART
FIG. 1 is a transverse sectional view illustrating a conventional arrangement.
Figure 2:
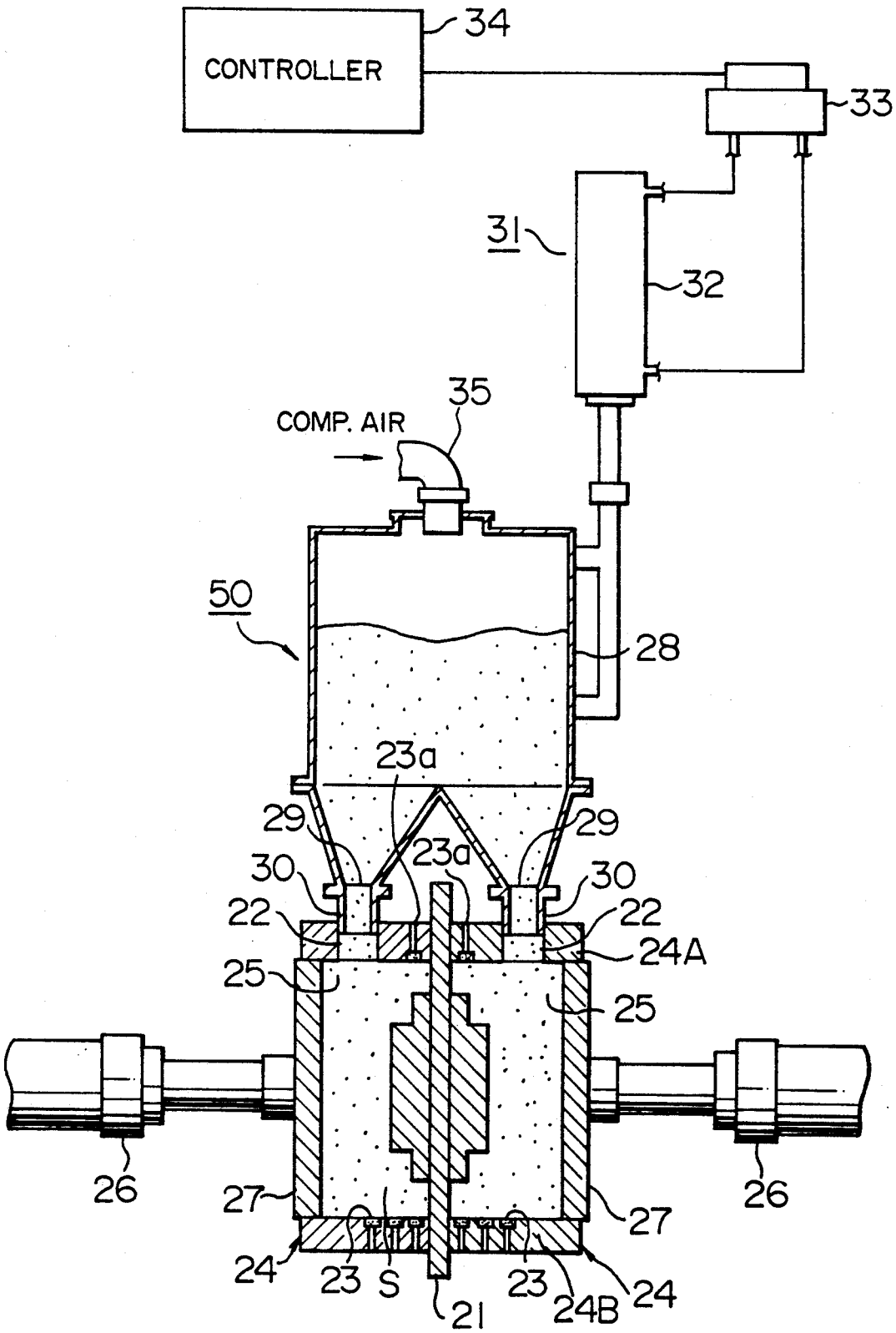
Figure 3:
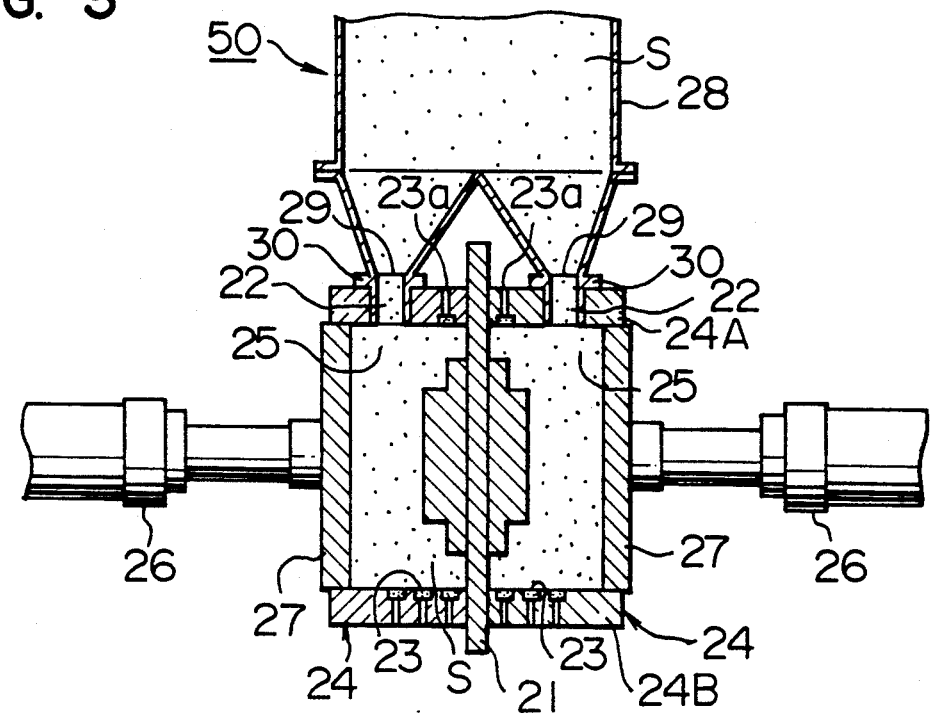

Referring to FIGS. 2 and 3, there is shown a molding machine which is denoted generally by reference numeral 50 in which a match plate 21 is arranged vertically and is clamped between left and right mold flasks 24, 24, each of which is formed in its top wall 24A with a sand charge port 22 and vent holes 23*a*, and in its bottom wall 24B with vent holes 23. The mold flasks 24, 24 are aligned and mated, at their front openings, with the match plate 21 on both sides of the latter. The rear openings 25, 25 of the mold flasks 24, 24 receive therethrough squeeze plates 27, 27, respectively, which are set respectively to piston rods extending from cylinders 26, 26. Accordingly, each of the mold flasks defines therein a closed sand charge space.

Above the mold flasks 24, 24, a blow head 28 is suspended and adapted to be vertically displaced by a drive mechanism, generally denoted by reference numeral 31, which is attached to a machine frame (not shown). The drive mechanism includes a fluid cylinder 32 which is controlled by a controller 34 by way of a selector valve 33 so that the blow head 28 can be stopped at a suitable height. The blow head 28 is fixed at its bottom part with cone portions 29, 29 which are, in turn fixed to sand feed nozzles 30, 30 whose length is substantially equal to the thickness of the top walls 24A of the mold flasks 24, 24 or the depth of the sand charge ports 22, and whose diameter is slightly less than the bore diameter of the sand charge ports 22. The blow head 28 is set so as to align the nozzles 30, 30 with the sand charge ports 22, 22, respectively.

Further, compressed air is fed into the blow head 28 through a pipe line 35, so that sand is charged into the spaces in the mold flasks 24, 24 through the sand feed nozzle 30, 30 and the sand charge ports 22, 22.

Next, explanation will be made of operation of the molding machine.

The blow head 28 stored therein with sand S is lowered by the cylinder 32 under the control of the controller 34. When the lower sections of the sand feed nozzles 30, 30 enter into the sand charge ports 22, 22 at an intermediate depth of the sand charge ports 22, 22 (refer to FIG. 2), the controller 34 stops the operation of the cylinder 32.

Then, the blow head 28 is energized by feeding compressed air thereinto so as to charge the sand S into the spaces in the mold flasks 24, 24. It is noted that the sand S is filled upward from the bottom walls 24B of the flasks 24, 24. The higher the level of the sand charged in each space, the lower the air vent capacity becomes, since the capacity of vent air through the vent ports 23 in the bottom wall 24B of the mold flask is greatly lower than that of the vent holes 23A. The nearer the sand is to the level of the sand charge ports 22, 22, the lower the density of the charged sand S becomes.

Then, the controller 34 operates the cylinder 32 so as to lower the blow head 28 until the lower ends of the sand feed nozzles 30, 30 come down to a level substantially equal to the level of the lower ends of the sand charge ports 22, 22, that is, until the nozzles 30, 30 are moved to extend the full depth of the sand charge ports 22, 22, as shown in FIG. 3. Accordingly, sand filled in the sand charge ports 22, 22 is pressed into the mold sand charge space. This causes the density of the sand S in the vicinity of the sand charge ports 22, 22 to be heightened. Accordingly, the density of the sand charged in each of the sand charge spaces in the mold flasks 24, 24 is made to be uniform in its entirety.

It is noted here that the depth of the insertion of the sand charge nozzles 30, 30 into the sand charge ports 22, 22 should be adjusted in order to have an entirely uniform density of the charged sand in the spaces.

Then, the squeeze cylinders 26, 26 are extended to press the squeeze plates 27, 27 against the charged sand in the spaces so as to compact the sand S, and accordingly, sand molds are formed.

Although the present invention has been explained in the form of an embodiment, the present invention should not be limited to this embodiment, but various changes and modifications can be made thereto without departing the spirit and scope of the invention which is only defined by the appended claims.

Figure 4:
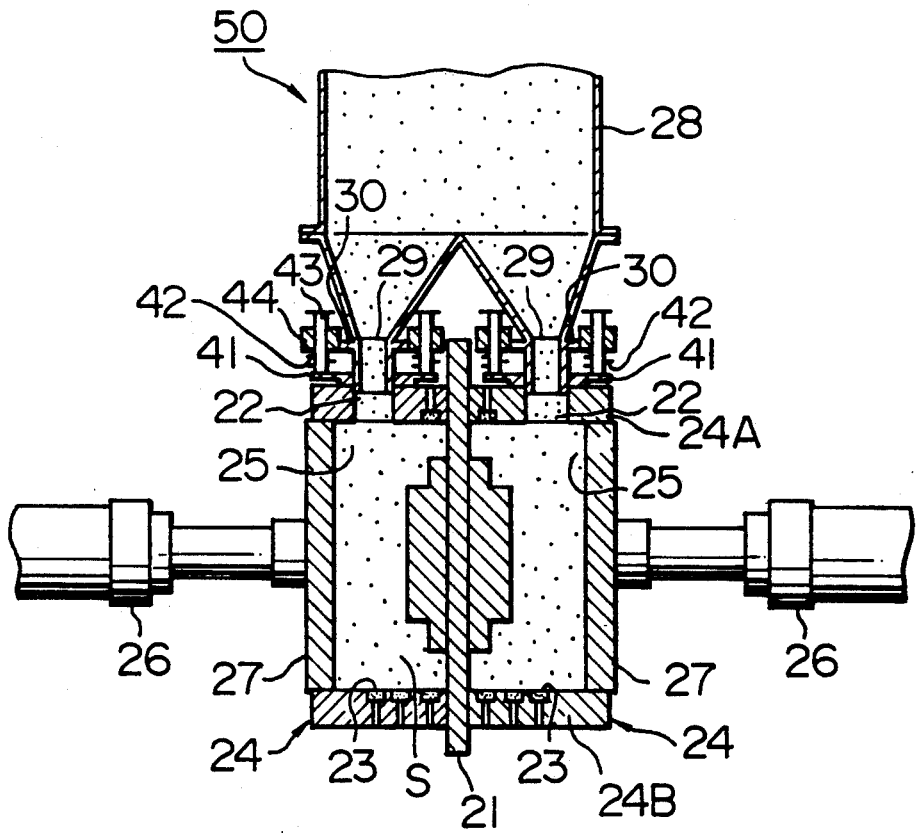
FIG. 4 is a transverse sectional view illustrating a variant form of the embodiment shown in FIGS. 2 and 3.

For example, as shown in FIG. 4, separate press-contact plate mechanisms can preferably be provided for each of the sand feed nozzles 22, 22. Each of these press-contact plate mechanisms is composed of a press-contact plate 41 having a bore, the shape of which is substantially equal to the outer shape of the sand feed nozzle 30 and slidably fitted onto the latter, a rod 43 planted on the press-contact plate 41 and slidably fitted in a hole formed in an attaching flange part 44 fixed to the lower end part of the associated cone portion 29 of the blow head 28, and a coil spring 42 surrounding the rod 43 and urging the press-contact plate 41 toward the top wall 24A of the mold flask 24.

Accordingly, when the blow head 28 is lowered, the press-contact plate 41 at first makes contact with the top wall 24A of the mold flask 24 so as to seal the associated sand charge port 22 therearound. Thereby, even though the clearance between the sand charge port 22 and the sand feed nozzle 30 fitted thereinto is large, the blow-out of the sand S can be prevented by the press-contact plate 41. Accordingly, the mechanical clearance of the sand feed nozzle 30 and the sand charge port 22 can be made wide.

What is claimed:

1. A method for charging sand into a space in a vertically arranged mold flask, the mold flask being formed with a sand charge port having a given depth and a plurality of vent holes in its top wall and having a plurality of vent holes in its bottom wall, and defining openings on both sides which are closed air-tight, respectively, by a match plate and a squeeze plate, the method comprising the steps of:

inserting a sand feed nozzle into said sand charge port at an intermediate depth of said sand charge port;

charging said into said space from a blow head together with compressed air through said sand feed nozzle and said sand charge port while venting air from the space through said vent holes so as to fill the space with the sand; and forcing said sand feed nozzle inserted in said sand charge port to advance into said sand charge port by a certain depth so as to compress the sand charged in the space.

2. A method as set forth in claim 1, wherein a press-contact plate slidably fitted onto said sand feed nozzle at first makes contact with said top wall of said mold flask so as to seal said sand charge port therearound when said sand feed nozzle is inserted in said sand charge port, whereby blow-out of the sand through a gap between said sand feed nozzle and said sand charge port is prevented during the period sand is charged into said space.

3. A method as set forth in claim 1, wherein said certain depth with which the lower end of said sand feed nozzle is introduced into said sand charge port after the sand being charged into said space is previously determined, and the lower end of said sand feed nozzle is inserted by a distance substantially equal to the depth of said sand charge port.

4. A molding machine comprising:

a match plate having a side surface which carries thereon a mold pattern;

a mold flask arranged vertically and having a top wall formed therein with a sand charge port and a plurality of vent holes, and a bottom wall formed therein with a plurality of vent holes, and defining therein first and second side openings, said first side opening being pressed against one surface of said match plate while said second side opening receiving therethrough a squeeze plate carried by a squeeze drive means so as to define a closed space within said mold flask;

a blow head located above said mold flask and having a sand feed nozzle adapted to be inserted in said sand charge port in said top wall of the mold flask, for charging sand and compressed air into said space, means for lowering the blow head so as to insert said sand feed nozzle into said sand charge port of said mold flask; and a control means for controlling said lowering means so as to lower said blow head in order to insert said sand feed nozzle into the sand charge port by an intermediate depth during the charging of sand into said space, and then to further lower said blow head so as to insert said sand feed nozzle through said sand charge port to a full depth after completion of sand charging.

5. A molding machine as set forth in claim 4, further comprising press-contact plate mechanisms, wherein said press-contact plate mechanisms comprises:

a press-contact plate having a bore slidably fitted on said sand feed nozzle;

and means for urging said press-contact plate against said top wall of said mold flask so as to seal said sand charge port therearound.

6. A method for charging mold sand into spaces defined by squeeze plates in a pair of mold flasks arranged vertically and mated with each other with a match plate being held therebetween, each of said mold flasks being formed with a sand charge port having a given depth and a plurality of vent holes in its top wall and with a plurality of vent holes in its bottom wall, and defining openings on both sides which are closed airtight, respectively, by said match plate and the associated one of said squeeze plates, the method comprising the steps of:

inserting sand feed nozzles into said sand charge ports at an intermediate depth of said sand charge ports;

charging mold sand into said spaces from a blow head together with compressed air through said sand feed nozzles and said sand charge ports while venting air from said spaces through said vent holes so as to fill the spaces with the mold sand, and forcing said sand feed nozzles inserted in said sand charge ports to advance into the sand charge ports by a certain depth so as to compress the sand charged in said spaces.

* * * * *